US011841193B2

(12) United States Patent
Joardar et al.

(10) Patent No.: US 11,841,193 B2
(45) Date of Patent: Dec. 12, 2023

(54) HEAT EXCHANGER FOR RESIDENTIAL HVAC APPLICATIONS

(71) Applicant: Carrier Corporation, Palm Beach Gardens, FL (US)

(72) Inventors: Arindom Joardar, Jamesville, NY (US); Kazuo Saito, Glastonbury, CT (US); Cheng Chen, Avon, IN (US); Michael F. Taras, Fayetteville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 21 days.

(21) Appl. No.: 17/375,661

(22) Filed: Jul. 14, 2021

(65) Prior Publication Data

US 2021/0341227 A1 Nov. 4, 2021

Related U.S. Application Data

(62) Division of application No. 15/365,131, filed on Nov. 30, 2016, now abandoned.

(Continued)

(51) Int. Cl.
*F28D 7/00* (2006.01)
*F28F 9/02* (2006.01)

(Continued)

(52) U.S. Cl.
CPC ..... *F28D 7/0066* (2013.01); *F25B 39/028* (2013.01); *F28F 9/02* (2013.01);

(Continued)

(58) Field of Classification Search
CPC ..... F28F 9/0212; F28F 9/0209; F28F 9/0263; F28F 9/028; F28F 9/026; F28D 1/05391; F25B 39/028; F25B 39/04
See application file for complete search history.

(56) References Cited

U.S. PATENT DOCUMENTS 2,576,610 A * 11/1951 Kunzog ..... F25B 41/30 138/41
4,407,137 A 10/1983 Hayes, Jr.

(Continued)

FOREIGN PATENT DOCUMENTS

DE 10322165 A1 12/2004
EP 1043552 A1 10/2000

(Continued)

OTHER PUBLICATIONS

Adivisory Action for U.S. Appl. No. 15/365,131, dated Feb. 4, 2020, 4 pages.

(Continued)

*Primary Examiner* — Jianying C Atkisson
*Assistant Examiner* — For K Ling
(74) *Attorney, Agent, or Firm* — CANTOR COLBURN LLP

(57) ABSTRACT

A heat exchanger is provided including a first header and a second header and a plurality of heat exchange tube arranged in spaced parallel relationship and fluidly coupling the first and second header. A flow restricting element defining a first volume and a second volume is positioned within one of the first and second header. The heat exchanger has a multi-pass configuration such that a first portion of the plurality of heat exchange tubes are coupled to the first volume and form a first fluid pass of the heat exchanger and a second portion of the plurality of heat exchange tubes are coupled to the second volume and form a second fluid pass of the heat exchanger. During operation, the heat transfer fluid conveyed through the first volume has a first saturation temperature and the heat transfer fluid conveyed through the second volume has a different second saturation temperature.

15 Claims, 9 Drawing Sheets

Related U.S. Application Data

(60) Provisional application No. 62/260,963, filed on Nov. 30, 2015.

(51) Int. Cl.
*F28F 27/02* (2006.01)
*F25B 39/02* (2006.01)

(52) U.S. Cl.
CPC ..... *F28F 9/026* (2013.01); *F28F 9/028* (2013.01); *F28F 27/02* (2013.01); *F28F 2250/06* (2013.01)

(56) References Cited

U.S. PATENT DOCUMENTS

| | | | | |
|---|---|---|---|---|
| 5,097,866 | A * | 3/1992 | Shapiro-Baruch | F25B 41/30 137/550 |
| 5,186,249 | A | 2/1993 | Bhatti et al. | |
| 5,203,407 | A | 4/1993 | Nagasaka | |
| 5,255,737 | A | 10/1993 | Gentry et al. | |
| 5,752,566 | A | 5/1998 | Liu et al. | |
| 5,988,267 | A | 11/1999 | Park et al. | |
| 6,062,303 | A | 5/2000 | Ahn et al. | |
| 6,250,103 | B1 * | 6/2001 | Watanabe | F28D 1/0316 62/509 |
| 7,367,388 | B2 | 5/2008 | Yagisawa | |
| 7,942,020 | B2 | 5/2011 | Knight et al. | |
| 8,235,101 | B2 | 8/2012 | Taras et al. | |
| 8,869,545 | B2 | 10/2014 | Chen et al. | |
| 2008/0023182 | A1 | 1/2008 | Beamer et al. | |
| 2008/0099191 | A1 * | 5/2008 | Taras | F28F 9/028 165/174 |
| 2010/0206535 | A1 | 8/2010 | Munoz et al. | |
| 2011/0139413 | A1 | 6/2011 | Coyle et al. | |
| 2012/0011867 | A1 * | 1/2012 | Koons | F28D 1/0443 165/165 |
| 2015/0021003 | A1 * | 1/2015 | Cho | F28F 9/028 165/145 |
| 2015/0107296 | A1 * | 4/2015 | Lee | F28D 1/05325 62/526 |
| 2015/0251517 | A1 | 9/2015 | Heyl et al. | |
| 2017/0153062 | A1 | 6/2017 | Joardar et al. | |

FOREIGN PATENT DOCUMENTS

| | | | | |
|---|---|---|---|---|
| EP | 1065453 | A2 | | 1/2001 |
| EP | 1298405 | A2 | | 4/2003 |
| JP | H03140764 | A | | 6/1991 |
| JP | 2000356437 | A | * | 12/2000 |
| JP | 2005140374 | A | | 6/2005 |
| JP | 2010127510 | A | * | 6/2010 |
| JP | 2010127510 | A | | 6/2010 |
| KR | 20040051642 | A | | 6/2004 |
| KR | 101462176 | B1 | * | 11/2014 |
| KR | 101462176 | B1 | | 11/2014 |
| WO | 2008048251 | A2 | | 4/2008 |
| WO | 2014186251 | A1 | | 11/2014 |
| WO | 2014197960 | A1 | | 12/2014 |

OTHER PUBLICATIONS

EP Communication; Extended European Search Report; Application No. 16201191.0-1602; dated Sep. 26, 2017; pp. 1-7.

Final Office Action for U.S. Appl. No. 15/365,131, dated Oct. 1, 2019, 13 pages.

Final Office Action for U.S. Appl. No. 15/365,131, dated Apr. 14, 2021, 43 pages.

Non Final Office Action for U.S. Appl. No. 15/365,131, dated Mar. 20, 2019, 48 pages.

Non Final Office Action for U.S. Appl. No. 15/365,131, dated Apr. 21, 2020, 13 pages.

* cited by examiner

HEAT EXCHANGER FOR RESIDENTIAL HVAC APPLICATIONS

CROSS REFERENCE TO RELATED APPLICATIONS

This application is a divisional of U.S. patent application Ser. No. 15/365,131, filed Nov. 30, 2016, which claims the benefit of U.S. provisional application Ser. No. 62/260,963 filed Nov. 30, 2015, the contents of which are incorporated by reference in its entirety herein.

BACKGROUND

This disclosure relates generally to heat exchangers and, more particularly, to a heat exchanger configured for use as an outdoor heat exchanger in residential air conditioning and heat pump applications.

In recent years, much interest and design effort has been focused on the efficient operation of heat exchangers of refrigerant systems, particularly condensers and evaporators. A relatively recent advancement in heat exchanger technology includes the development and application of parallel flow (such as microchannel, minichannel, brazed-plate, plate-fin, or plate-and frame) heat exchangers as condensers and evaporators.

SUMMARY

According to an embodiment, a heat exchanger is provided including a first header and a second header and a plurality of heat exchange tube arranged in spaced parallel relationship and fluidly coupling the first and second header. A flow restricting element defining a first volume and a second volume is positioned within one of the first and second header. The heat exchanger has a multi-pass configuration such that a first portion of the plurality of heat exchange tubes are coupled to the first volume and form a first fluid pass of the heat exchanger and a second portion of the plurality of heat exchange tubes are coupled to the second volume and form a second fluid pass of the heat exchanger. During operation, the heat transfer fluid conveyed through the first volume has a first saturation temperature and the heat transfer fluid conveyed through the second volume has a different second saturation temperature.

In addition to one or more of the features described above, or as an alternative, in further embodiments a difference between the second saturation temperature and the first saturation temperature exceeds normal temperature variation within the at least one of the first header and second header.

In addition to one or more of the features described above, or as an alternative, in further embodiments the flow restricting element imparts a pressure drop on the heat transfer fluid conveyed there through during operation causing the first saturation temperature and the second saturation temperature to be different.

In addition to one or more of the features described above, or as an alternative, in further embodiments the pressure drop is between about 3 psi and about 12 psi.

In addition to one or more of the features described above, or as an alternative, in further embodiments the pressure drop is about 6 psi.

In addition to one or more of the features described above, or as an alternative, in further embodiments the flow restricting element comprises an orifice.

In addition to one or more of the features described above, or as an alternative, in further embodiments a cross-sectional area of the orifice is between about 3% and about 30% of a cross-sectional area of the at least one of the first header and the second header in which it is disposed.

In addition to one or more of the features described above, or as an alternative, in further embodiments a distributor fluidly coupled to the orifice is arranged within the second volume and is adjacent at least the second portion of the plurality of heat exchange tubes.

In addition to one or more of the features described above, or as an alternative, in further embodiments a porous insert is positioned within the second volume adjacent at least the second portion of the plurality of heat exchange tubes. The porous insert is configured to restrict a fluid flow path between the first fluid pass and the second fluid pass.

In addition to one or more of the features described above, or as an alternative, in further embodiments the flow restricting element comprises a flow control valve. The flow control valve is movable to adjust a parameter of a fluid flow path between the first fluid pass and the second fluid pass.

In addition to one or more of the features described above, or as an alternative, in further embodiments the plurality of heat exchange tubes are microchannel tubes.

In addition to one or more of the features described above, or as an alternative, in further embodiments the first header comprises one or more partitions disposed therein and defining two or more discrete fluid volumes.

In addition to one or more of the features described above, or as an alternative, in further embodiments the first header comprises two baffles forming three first header volumes and the second header comprises two flow restricting elements forming a first, second, and third second header volume.

In addition to one or more of the features described above, or as an alternative, in further embodiments during operation, a heat transfer fluid conveyed through the first volume has a first saturation temperature and the heat transfer fluid conveyed through the third volume has a third saturation temperature. The first saturation temperature and the third saturation temperature are different.

In addition to one or more of the features described above, or as an alternative, in further embodiments the second saturation temperature and the third saturation temperature are generally identical.

In addition to one or more of the features described above, or as an alternative, in further embodiments the second saturation temperature and the third saturation temperature are distinct.

BRIEF DESCRIPTION OF THE DRAWINGS

The subject matter, which is regarded as the present disclosure, is particularly pointed out and distinctly claimed in the claims at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Microchannel heat exchangers as outdoor coil units are being considered for use in residential heat pump and air conditioning applications. Due to regulatory efficiency requirements, sound constraints, and a non-optimized heat exchanger design, the size of the outdoor heat exchanger is typically large. As a result, the heat pump and air conditioning systems incur higher costs and have a higher refrigerant charge. Current legislation limits the amount of charge of refrigerant systems, and heat exchangers in particular, containing most low global warming potential refrigerants (currently classified as A2L substances).

Microchannel heat exchangers have a small internal volume and therefore store less refrigerant charge than conventional round tube plate fin heat exchangers. Although a lower refrigerant charge is generally beneficial, the smaller internal volume of microchannel heat exchangers makes them extremely sensitive to overcharge or undercharge situations, which could result in refrigerant charge imbalance, degrade refrigerant system performance, and cause nuisance shutdowns. In addition, the refrigerant charge contained in the manifolds of the microchannel heat exchanger, particularly when the heat exchanger operates as a condenser, is significant, such as about half of the total heat exchanger charge. As a result, the refrigerant charge reduction potential of the heat exchanger is limited.

Figure 1:
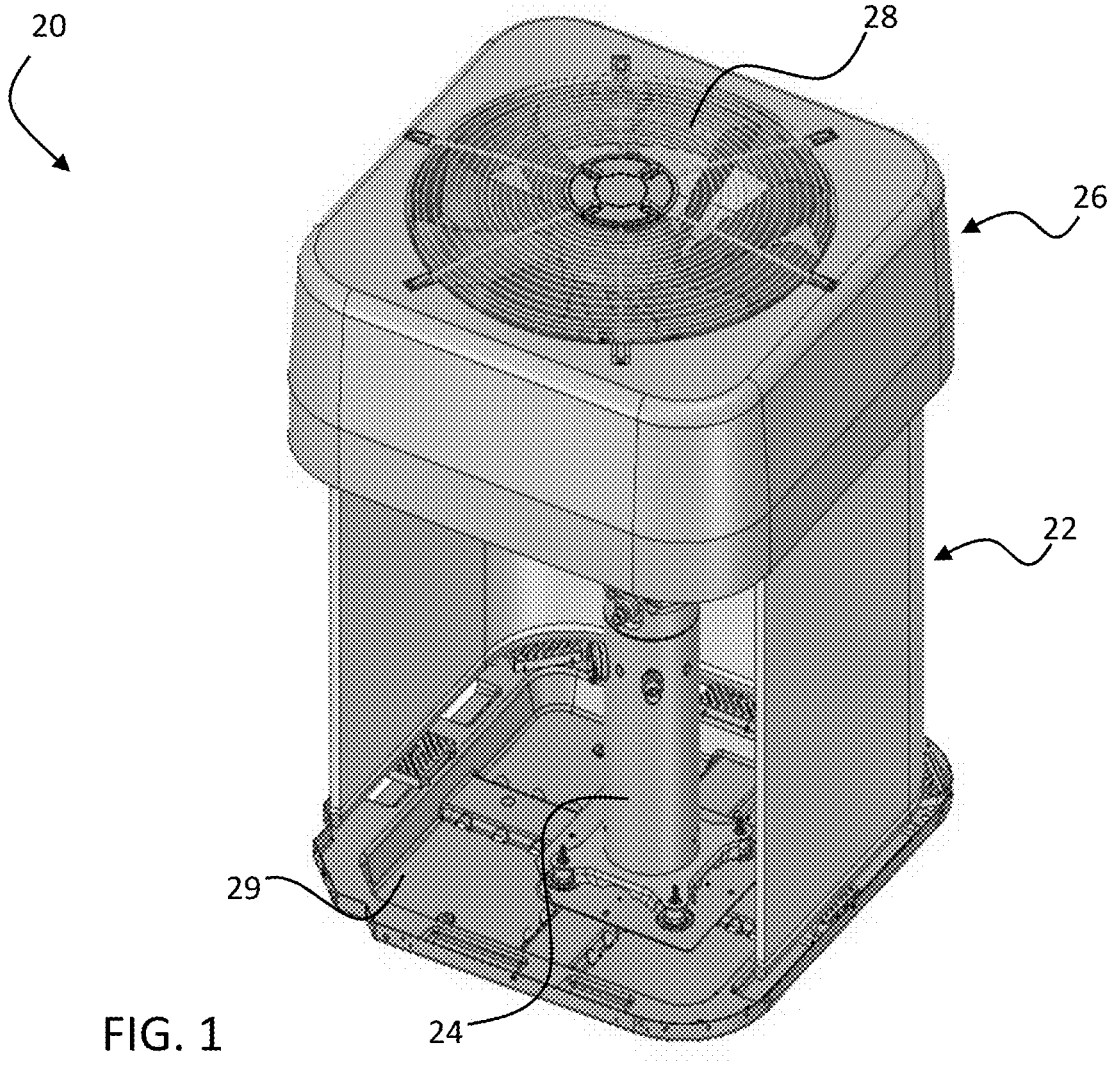
FIG. 1 is an example of an outdoor coil unit according to an embodiment.

Referring now to FIG. 1, an outdoor coil unit 20 of an air conditioning system is illustrated. The outdoor coil unit 20 includes a heat exchanger 22 having a generally square structure, although embodiments where the heat exchanger 22 is rectangular, cylindrical, or another shape are also within the scope of the disclosure. A compressor 24, fluidly coupled to the heat exchanger 22 is positioned within the interior of the heat exchanger 22 and is configured to pump a heat transfer fluid through a vapor compression cycle. Examples of the heat transfer fluid contemplated for use in the system 20 described herein include refrigerants, CO2, oil, brine, and other suitable fluids.

Disposed in contact with a surface of the heat exchanger 22 is a fan assembly 26 configured to draw ambient air radially inward, through the heat exchanger 22, after which the air is discharged upwardly through an opening 28. In an embodiment, the unit 20 includes a floor pan 29 configured to hold the heat exchanger 22 in place.

Figure 2:
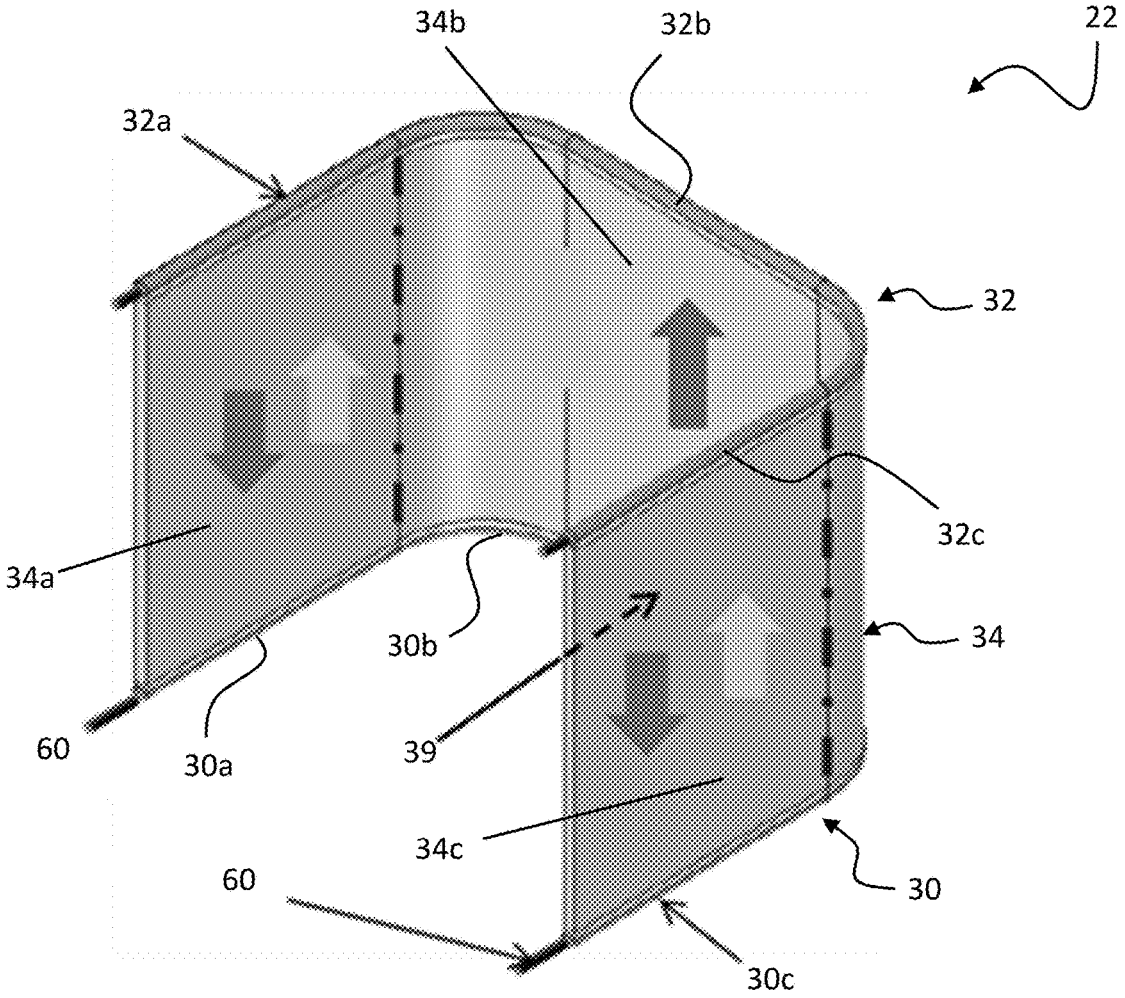
FIG. 2 is a perspective view of the heat exchanger of the outdoor unit of FIG. 1 according to an embodiment.
Figure 3:
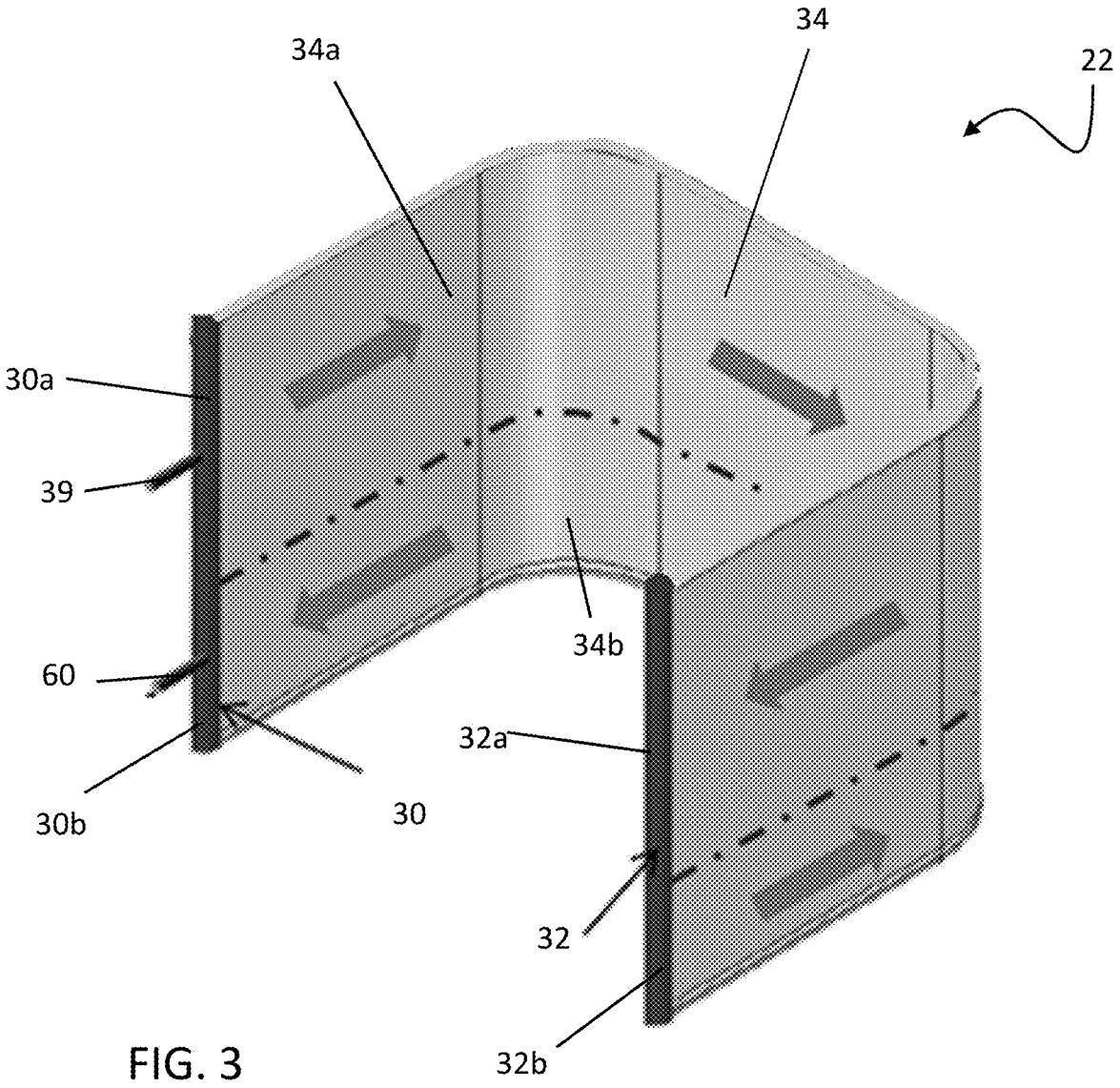
FIG. 3 is a perspective view of the heat exchanger of the outdoor unit of according to an embodiment.

With reference now to FIGS. 2 and 3, examples of a heat exchanger 22 of the outdoor coil unit 20 are illustrated in more detail. The heat exchanger 22 includes a first manifold 30 (also referred to herein as first header 30), a second manifold 32 (also referred to herein as second header 32) spaced apart from the first manifold 30, and a plurality of heat exchange tubes 34 extending in a spaced parallel relationship between and fluidly connecting the first header 30 and the second header 32. In FIG. 2, the first header 30 and the second header 32 are oriented generally horizontally or level and are bent to form a heat exchanger 22 having a desired shape (e.g., a "C", "U", "V", "W", or "J" shape). The heat exchange tubes 34 extend generally vertically between the two headers 30, 32. By arranging the tubes 34 vertically, as shown in FIG. 2, water condensate collected on the tubes 50 is more easily drained from the heat exchanger 30. However, in other embodiments, such as shown in FIG. 3, a heat exchanger 22 having another configuration, such as where the headers 30, 32 are arranged vertically and the plurality of heat exchanger tubes 34 extend horizontally for example, are within the scope of the disclosure.

In the non-limiting embodiments illustrated in the FIGS., the headers 30, 32 comprise hollow, closed end cylinders having a circular cross-section. However, headers 30, 32 having other configurations, such as elliptical, semi-elliptical, square, rectangular, hexagonal, octagonal, or other cross-sections for example, are within the scope of the disclosure. The heat exchanger 22 may be used as either a condenser or an evaporator in a vapor compression system, such as a heat pump system or air conditioning system for example.

Figure 4:
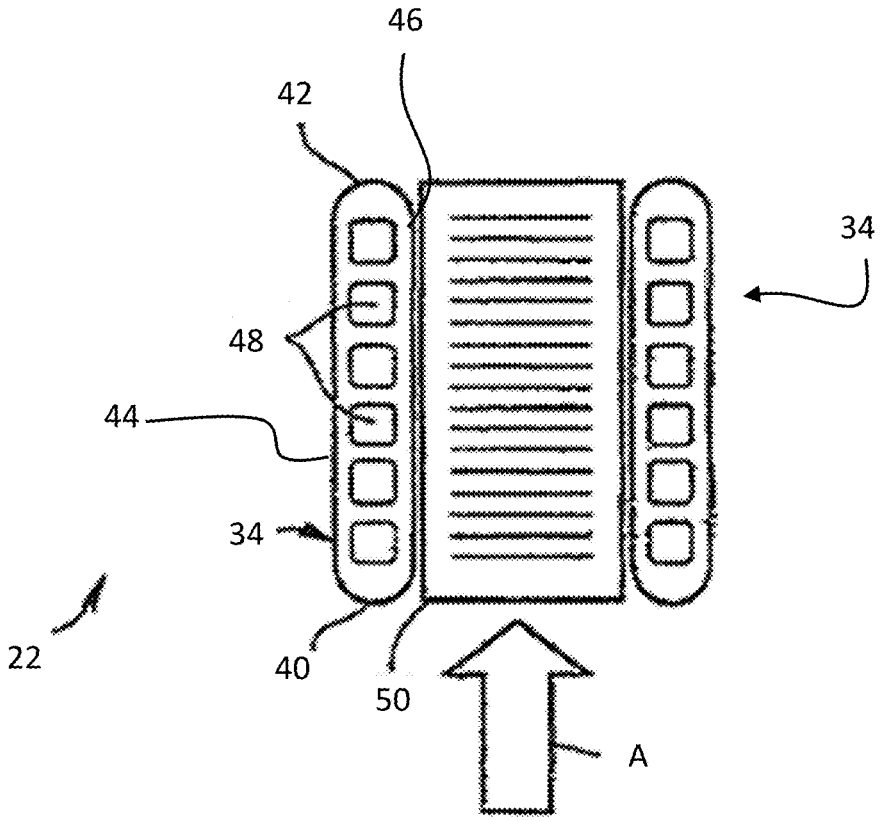
FIG. 4 is a cross-sectional view of a portion of the heat exchanger of FIG. 2.

The heat exchanger 22 can be any type of heat exchanger, such as a round tube plate fin (RTPF) type heat exchanger or a microchannel heat exchanger for example. Referring now to FIG. 4, in embodiments where the heat exchanger 22 is a microchannel heat exchanger, each heat exchange tube 34 comprises a flattened heat exchange tube having a leading edge 40, a trailing edge 42, a first surface 44, and a second surface 46. The leading edge 40 of each heat exchanger tube 34 is upstream of its respective trailing edge 42 with respect to an airflow A through the heat exchanger 22. The interior flow passage of each heat exchange tube 34 may be divided by interior walls into a plurality of discrete flow channels 48 that extend over the length of the tubes 34 from an inlet end to an outlet end and establish fluid communication between the respective first and second manifolds 30, 32. The flow channels 48 may have a circular cross-section, a rectangular cross-section, a trapezoidal cross-section, a triangular cross-section, or another non-circular cross-section. The heat exchange tubes 34 including the discrete flow channels 48 may be formed using known techniques and materials, including, but not limited to, extrusion or folding.

A plurality of heat transfer fins 50 (FIG. 4) may be disposed between and rigidly attached, e.g., by a furnace braze process, to the heat exchange tubes 34, in order to enhance external heat transfer and provide structural rigidity to the heat exchanger 22. The fins 50 may be configured with any of a plurality of configurations. In one embodiment, each fin 50 is formed from a plurality of connected strips or a single continuous strip of fin material tightly folded in a ribbon-like serpentine fashion. Heat exchange between the fluid within the heat exchanger tubes 34 and the air flow A, occurs through the outside surfaces 44, 46 of the heat exchange tubes 34 collectively forming the primary heat exchange surface, and also through the heat exchange surface of the fins 50, which form the secondary heat exchange surface.

The heat exchanger 22 may be configured with a single or multi-pass flow configuration. To form a multi-pass flow configuration, at least one of the first manifold 30 and the second manifold 32 includes two or more fluidly distinct sections or chambers. In one embodiment, the fluidly distinct sections are formed by coupling separate manifolds together to form the first or second manifold 30, 32. Alternatively, a baffle or divider plate (not shown) known to a person of ordinary skill in the art may be arranged within at least one of the first header 30 and the second header 32 to define a plurality of fluidly distinct sections therein.

In the illustrated, non liming embodiment of FIGS. 1-3, the heat exchanger 22 is configured with a two-pass flow arrangement. As a result, at least one of the first header 30 and the second header 32, and therefore the heat exchange tubes 34 fluidly connected to a portion of an interior volume of the headers 30, 32 can be divided into plurality of sections, such as a first, second, and third section, respectively. In FIGS. 2 and 3, the boundaries between adjacent groups of heat exchange tubes 34 are illustrated schematically with a dotted line. For example, the heat exchanger of FIG. 2 includes a first group 34*a* of heat exchanger tubes 34 extending vertically between and fluidly coupled to an inner volume of the first sections 30*a*, 32*a* of the first and second header 30, 32. A second group 34*b* of heat exchanger tubes 34 extends vertically between and fluidly couples an inner volume of the second sections 30*b*, 32*b* of the first and second header 30, 32. A third group 34*c* of heat exchanger tubes 34 extends vertically between and fluidly couples an inner volume of the third sections 30*c*, 32*c* of the first and second header 30, 32. Alternatively, in the heat exchanger 22 of FIG. 3, a first group 34*a* of heat exchanger tubes 34 extends horizontally between and fluidly couples an inner volume of the first sections 30*a*, 32*a* of the first and second header 30, 32 and a second group 34*b* of heat exchanger tubes 34 extends horizontally between and fluidly couples an inner volume of the second sections 30*b*, 32*b* of the first and second header 30, 32.

Although embodiments where the heat exchange tubes 34 are divided into two or three groups are illustrated, a heat exchanger having any number of passes and therefore any number groups of heat exchange tubes 34 is within the scope of the disclosure. A length of the plurality of sections of the headers 30, 32 and the number of tubes 34 within the distinct groups 34*a*, 34*b*, 34*c* may, but need not be substantially identical. In one embodiment, the sections of the headers 30, 32 are formed arranging a baffle plate or other divider 80 at a desired location within the headers 30, 32.

The direction of fluid flow through the heat exchanger 22, as illustrated by the arrows, depends on the mode in which the outdoor unit 20 is being operated. For example, when the heat exchanger 22 illustrated in FIG. 2 is configured to operate as an evaporator and heat the fluid therein, the two-phase heat transfer fluid moves through the heat exchanger in a direction indicated by a first set of arrows in the FIG. As shown, the two-phase heat transfer fluid is provided via an inlet 39 (shown with dashed line representing the inlet location behind the third group 34*c* of tubes 34 from the perspective of the figure) to the second section 30*b* of the first header 30. Within the second section 30*b*, the heat transfer fluid is configured to flow through the second group 34*b* of tubes 34 to the second section 32*b* of the second header 32. From the second section 32*b* of the second header 32, the fluid flow divided such that a portion of the fluid flows into the first section 32*a* of the second header 32 and a portion of the fluid flows into the third section 32*c* of the second header 32, and through the first and third groups of tubes 34*a*, 34*c*, respectively. Once received within the first section 30*a* of the first header 30 and the third section 30*c* of the first header 30, the fluid is provided via outlets 60 to a conduit (not shown) where the fluid is rejoined and provided to a downstream component of a vapor compression system.

As the heat transfer fluid flows sequentially through the second and first groups 34*b*, 34*a* of heat exchanger tubes 34, or alternatively, through the second and third groups 34*b*, 34*c* of heat exchanger tubes 34, heat from an adjacent flow of air A, is transferred to the heat transfer fluid. As a result, a substantially vaporized heat transfer fluid is provided at the outlets 60. Alternatively, heat transfer fluid is configured to flow in a reverse direction through the heat exchanger 22, indicated by a second set of arrows, when operated as a condenser. The configuration of the heat exchanger 22 illustrated and described herein is intended as an example only, and other types of heat exchangers 22 having any number of passes are within the scope of the disclosure.

Figure 5:
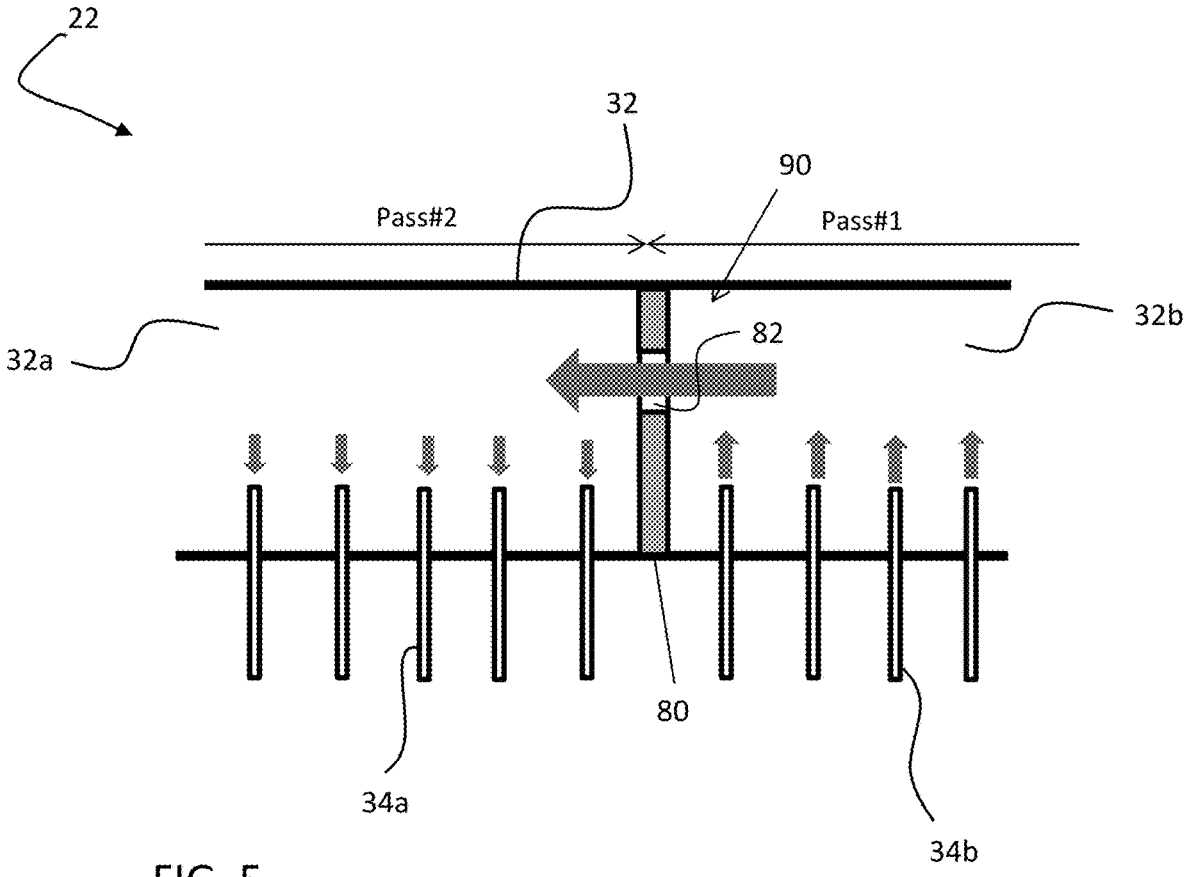
FIG. 5 is cross-sectional view of a header of a heat exchanger of the outdoor coil unit according to an embodiment.
Figure 6:
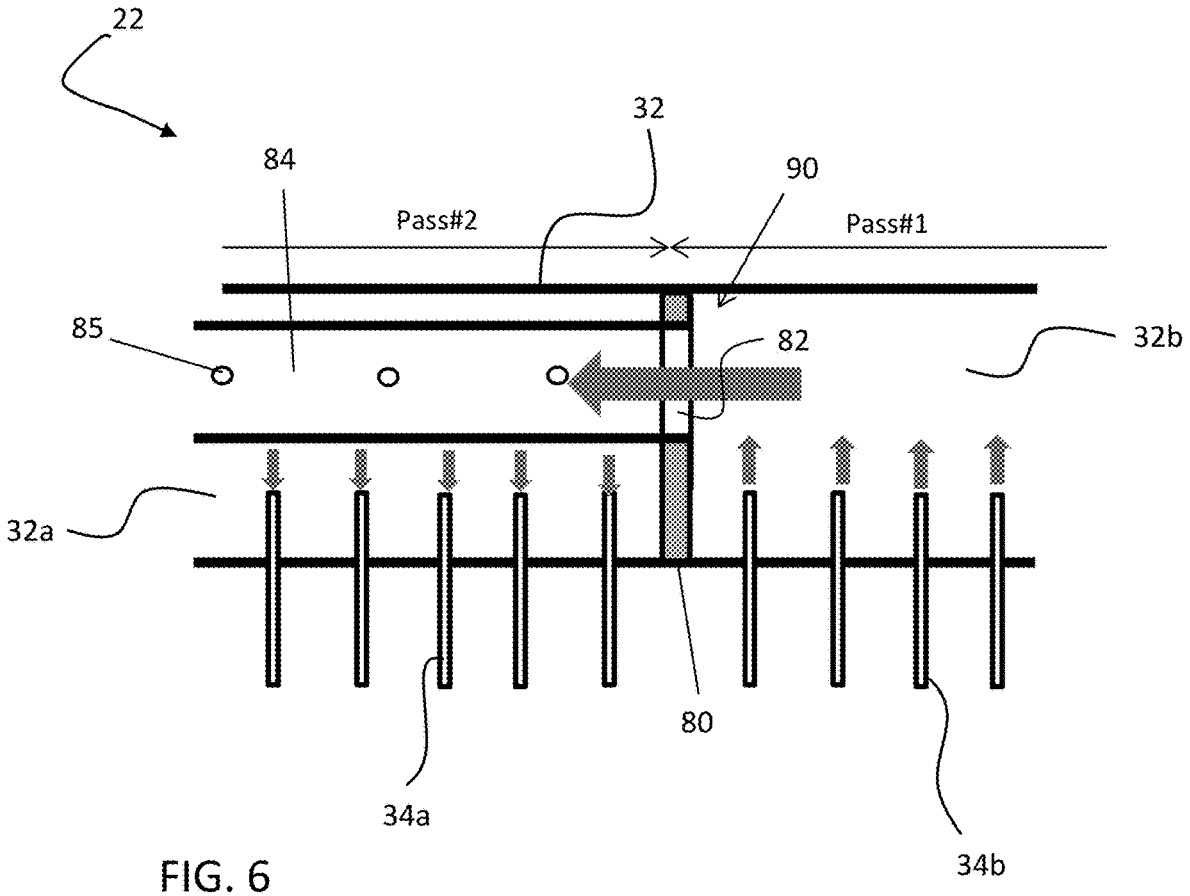
FIG. 6 is cross-sectional view of a header of a heat exchanger of the outdoor coil unit according to an embodiment.
Figure 7:
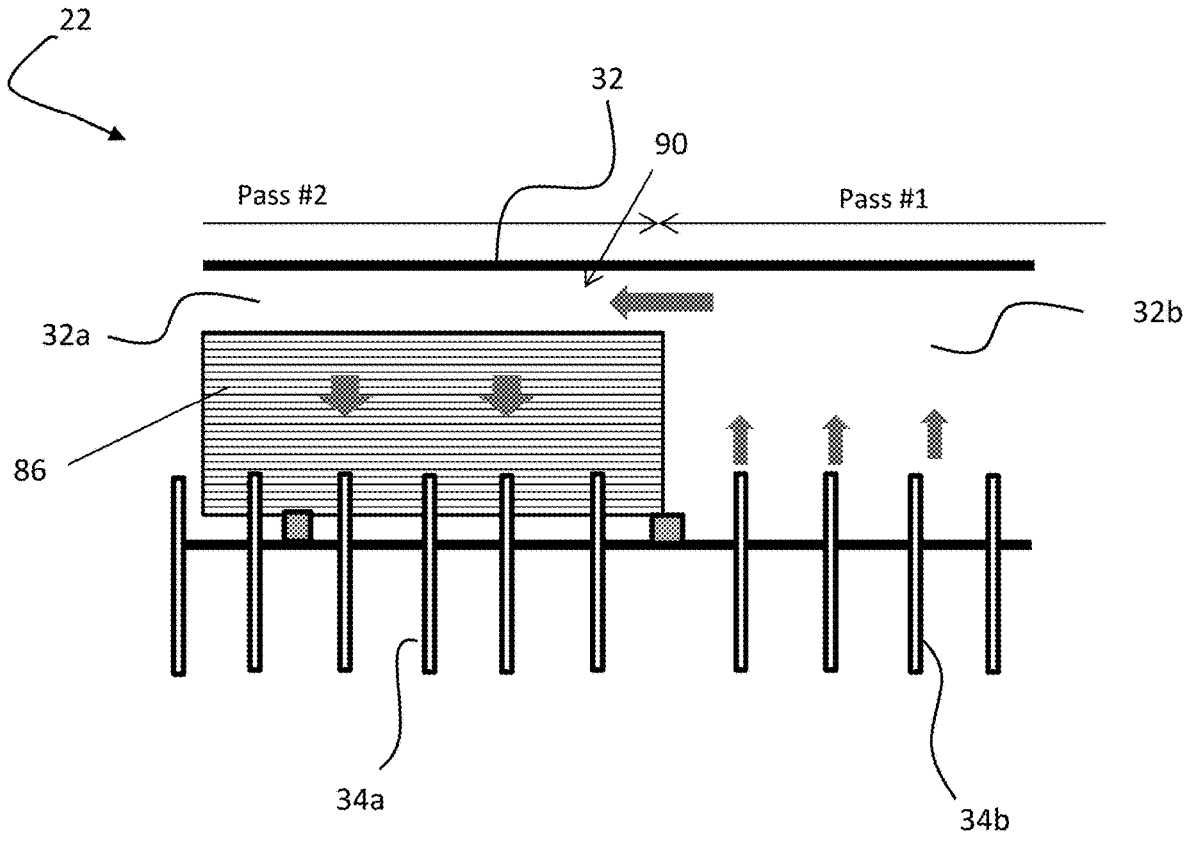
FIGS. 7 and 7*a* are various cross-sectional view of a header of a heat exchanger of the outdoor coil unit according to another embodiment
Figure 7A:
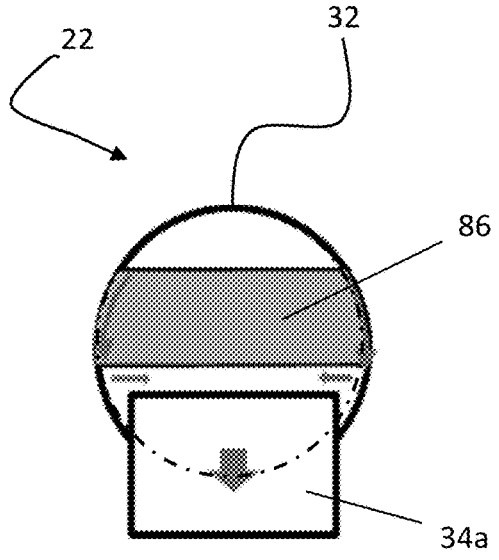

Referring now to FIGS. 5-7, fluid flow within the header 32 between a first volume associated with the first pass of the heat exchanger 22 and the second volume associated with the second pass of the heat exchanger 22, for example between the second section 32*b* and the first section 32*a* or between the second section 32*b* and the third section 32*c* of the second header 32, is restricted via a flow restricting element 90. Examples of the flow restricting element 90 include, but are not limited to, an orifice, a nozzle, a valve, a crimp, a convergent section of the interior header walls, a divergent section of the interior header walls, or generally anything that reduces the cross-sectional flow area within the header 32. In an embodiment, illustrated in FIG. 5, the flow restricting element 90 includes a flat plate orifice 82 with a straight bore. The flat plate orifice 82 may be formed within a baffle plate 80 and can be disposed within the header 32 such that the bore extends substantially parallel to the longest dimension of the header 32. The cross-sectional area of the orifice 82 is smaller than a cross-sectional area of the header 32. For example, the flow area through the orifice 82 may be between about 3% and about 30% of the cross-sectional area of the header 32.

Alternatively, or in addition, the flow restricting element 90 may include a longitudinally elongated distributor 84 (FIG. 6) arranged within at least a downstream section of the header 32 and fluidly coupled to the orifice 82 of the baffle plate 80. The distributor 84 may be arranged generally centrally within the inner volume of the header and includes one or more openings 85 configured to evenly distribute the flow of heat transfer fluid between the plurality of heat exchanger tubes 34 fluidly coupled thereto.

In another embodiment, the fluid restricting element 90 positioned within the header 32 between the first volume associated with the first pass and the second volume associated with the second pass of the heat exchanger 22 includes an insert 86 configured to reduce the inner volume thereof. The insert 86 can be formed from a metal or non-metal material, such as a foam, mesh, woven wire or thread, or a sintered metal for example, and can have a uniform or non-uniform porosity. The insert 86 may have at least one of a size and shape generally complementary to an interior of the header 32. A porosity of the insert 86 may be configured to change, such as uniformly for example, along the length of the header 32 in the direction of the heat transfer fluid flow. In an embodiment, the insert 86 is formed with a plurality of pockets or cavities (not shown), each cavity being configured to receive or accommodate one of the heat exchange tubes 34 extending into the header 32.

The insert 86 may be integrally formed with the header 32, or alternatively, may be a separate removable subassembly inserted into the inner volume thereof, such as supported on plates mounted therein for example. In addition, the porous insert 86 may be combined with any of the previously described flow restricting elements 90. For example, a distributor 84 may be inserted into the insert 86.

Figure 8:
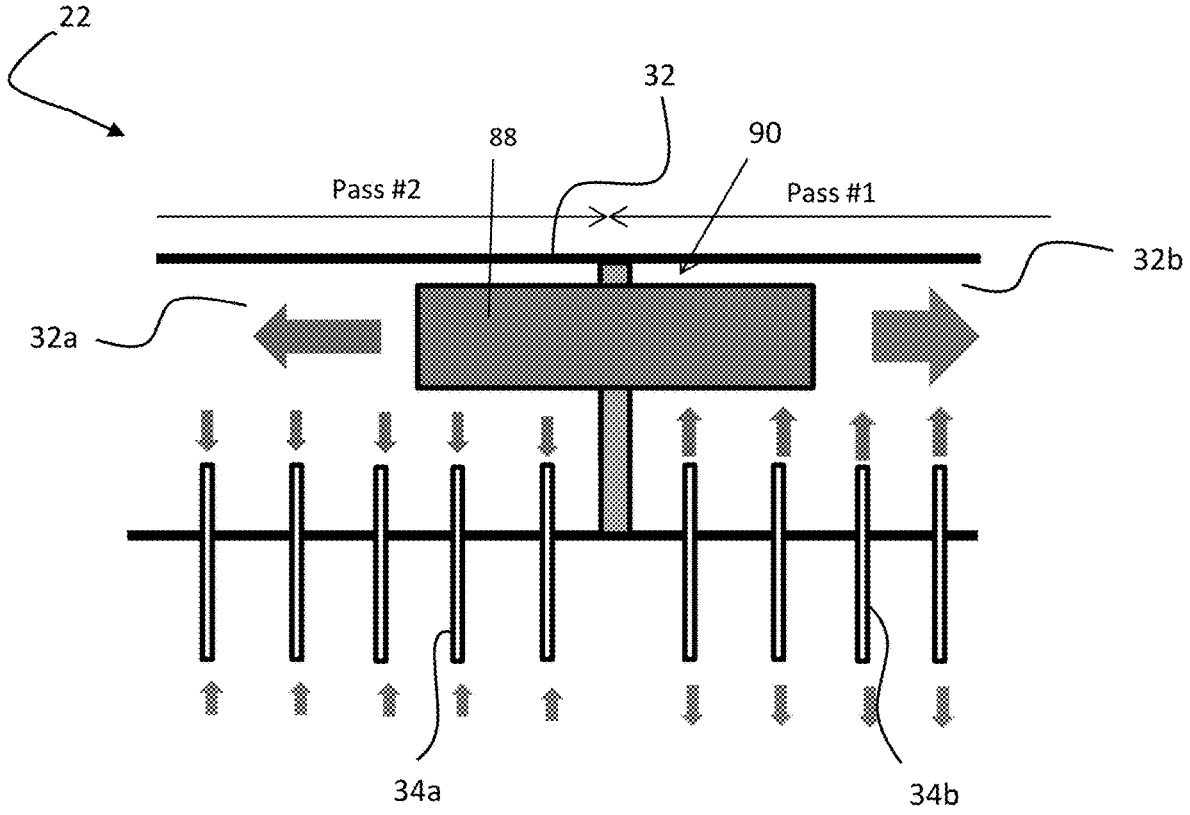
FIG. 8 is cross-sectional view of a header of a heat exchanger of the outdoor coil unit according to an embodiment.
Figure 9:
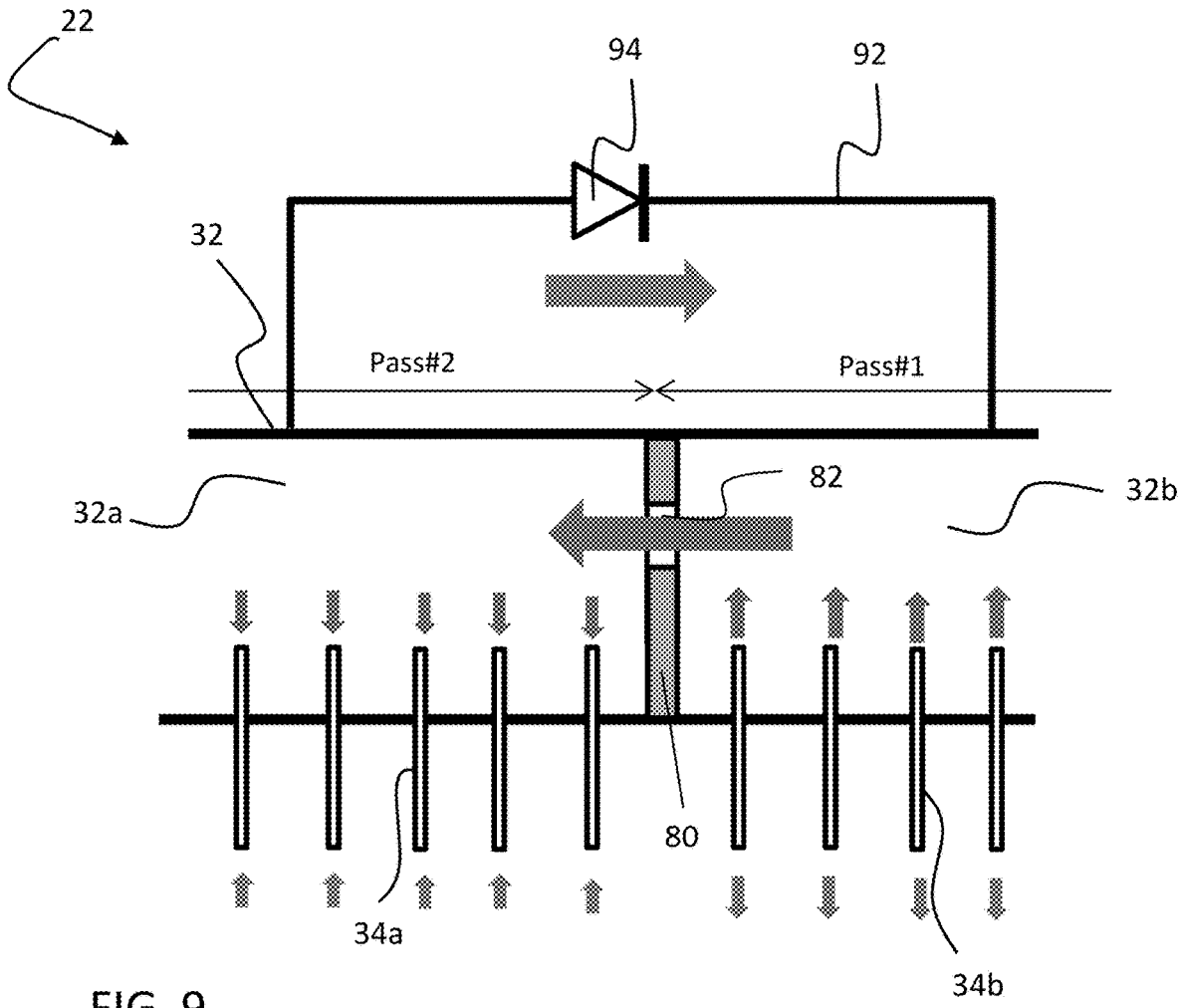
FIG. 9 is cross-sectional view of a header of a heat exchanger of the outdoor coil unit according to another embodiment.

In yet another embodiment,illustrated in FIG. 8, the flow restricting element 90 includes a flow control device 88, such as a valve or actuator for example, positioned within a header 32 between the first volume associated with the first pass and second volume associated with a second pass. The flow control device 88 may be adjustable to vary the volume of fluid flow depending on the mode of operation of the outdoor coil unit 20. When the outdoor coil unit 20 is operated as an evaporator, the valve may be arranged at a first position to restrict the volume of fluid flow between the first and second pass. However, when the outdoor coil unit 20 is operated as a condenser, and fluid is configured to flow through the heat exchanger 22 in a reverse direction, the valve is located at a second, fully open position such that the fluid flow between the first and second passes of the heat exchanger is unrestricted. Alternatively, the heat exchanger 22 may be provided with a bypass circuit 92 configured to bypass the orifice disposed between the first and second passes, as shown in FIG. 9. In one embodiment, the bypass circuit 92 includes a check valve 94 configured to restrict a flow through the bypass circuit to a single direction.

In conventional systems it is desirable to maintain a constant pressure throughout a fluid flow path of a heat exchanger to ensure even distribution of the liquid and gas phases of the fluid throughout the various passes. However, with respect to the heat exchanger 22 described herein, the various methods for restricting the fluid flow within a volume of the header create a pressure drop exceeding normal pressure variation within the header 32 between the first and second passes of the heat exchanger 22. In one embodiment, the pressure drop between the first and second passes is between about 3 pounds per square inch (psi) and about 12 psi, such as 6 psi for example.

The pressure drop between the first pass and the second pass of the heat exchanger 22 results in different saturation temperatures due to the hydraulic resistance created by the flow restricting element 90. As a result of this difference in saturation temperature, which exceeds normal saturation temperature variation within a header 32, the time required for frost to accumulate on the heat exchange tubes 34 of the portion of the heat exchanger 22 having a different saturation temperature increases, resulting in a longer frost-defrost cycle of the outdoor unit 20. The pressure drop between consecutive passes of the heat exchanger 22 may be optimized to achieve a desired saturation temperature difference, based not only on the heat exchanger 22 configuration, but also specific operating conditions.

The heating seasonal performance factor (HSPF) of the heat exchanger 22 is determined by the frost-defrost cycle time. An increase in the saturation pressure difference and frost-defrost cycle time, similarly results in an increased HSPF. As a result of this increase in HSPF, the size of the heat exchanger 22 may be optimized, resulting in both cost and space savings.

Embodiment 1: A heat exchanger, comprising:

a first header;

a second header, wherein at least one of the first header and the second header comprise a flow restricting element therein defining a first volume and a second volume; and a plurality of heat exchange tubes arranged in spaced parallel relationship and fluidly coupling the first header and second header;

wherein the heat exchanger has a multi-pass configuration such that a first portion of the plurality of heat exchange tubes are coupled to the first volume and form a first fluid pass of the heat exchanger and a second portion of the plurality of heat exchange tubes are coupled to the second volume and form a second fluid pass of the heat exchanger, wherein during operation a heat transfer fluid conveyed through the first volume has a first saturation temperature and the heat transfer fluid conveyed through the second volume has a second saturation temperature, wherein the first saturation temperature and the second saturation temperature are different.

Embodiment 2: The heat exchanger according to embodiment 1, wherein a difference between the second saturation temperature and the first saturation temperature exceeds normal temperature variation within the at least one of the first header and second header.

Embodiment 3: The heat exchanger according to embodiment 1, wherein the flow restricting element imparts a pressure drop on the heat transfer fluid conveyed there through during operation, causing the first saturation temperature and the second saturation temperature to be different.

Embodiment 4: The heat exchanger according to embodiment 3, wherein the pressure drop is between about 3 psi and about 12 psi.

Embodiment 5: The heat exchanger according to embodiment 3 or embodiment 4, wherein the pressure drop is about 6 psi.

Embodiment 6: The heat exchanger according to embodiment 3, wherein the flow restricting element comprises an orifice.

Embodiment 7: The heat exchanger according to embodiment 6, wherein a cross-sectional area of the orifice is between about 3% and about 30% of a cross-sectional area of the at least one of the first header and the second header in which it is disposed.

Embodiment 8: The heat exchanger according to embodiment 6 or embodiment 7, wherein a distributor fluidly coupled to the orifice is arranged within the second volume and is adjacent at least the second portion of the plurality of heat exchange tubes.

Embodiment 9: The heat exchanger according to any of the preceding embodiments, further comprising a porous insert positioned within the second volume adjacent at least the second portion of the plurality of heat exchange tubes, the porous insert being configured to restrict a fluid flow path between the first fluid pass and the second fluid pass.

Embodiment 10: The heat exchanger according to any of the preceding embodiments, wherein the flow restricting element comprises a flow control valve, the flow control valve being movable to adjust a parameter of a fluid flow path between the first fluid pass and the second fluid pass.

Embodiment 11: The heat exchanger according to any of the preceding embodiments, wherein the plurality of heat exchange tubes are microchannel tubes.

Embodiment 12: The heat exchanger according to any of the preceding embodiments, wherein the first header comprises one or more partitions disposed therein and defining two or more discrete fluid volumes.

Embodiment 13: The heat exchanger according to any of the preceding embodiments, wherein the first header comprises two baffles forming three first header inner volumes and the second header comprises two flow restricting elements forming a first, second, and third second header volume.

Embodiment 14: The heat exchanger according to embodiment 13, wherein during operation a heat transfer fluid conveyed through the first volume has a first saturation temperature and the heat transfer fluid conveyed through the third volume has a third saturation temperature, wherein the first saturation temperature and the third saturation temperature are different.

Embodiment 15: The heat exchanger according to embodiment 14, wherein the second saturation temperature and the third saturation temperature are generally identical.

Embodiment 16: The heat exchanger according to embodiment 14, wherein the second saturation temperature and the third saturation temperature are distinct.

While the present disclosure has been particularly shown and described with reference to the exemplary embodiments as illustrated in the drawing, it will be recognized by those skilled in the art that various modifications may be made without departing from the scope of the present disclosure. Therefore, it is intended that the present disclosure not be limited to the particular embodiment(s) disclosed as, but that the disclosure will include all embodiments falling within the scope of the appended claims.

What is claimed is:

1. A heat exchanger, comprising:

a first header;

a second header including a flow restricting element therein defining a first volume and a second volume; and a plurality of heat exchange tubes arranged in spaced parallel relationship and fluidly coupling the first header and the second header;

wherein the heat exchanger has a multi-pass configuration such that a first portion of the plurality of heat exchange tubes are coupled to the first volume and form a first fluid pass of the heat exchanger and a second portion of the plurality of heat exchange tubes are coupled to the second volume and form a second fluid pass of the heat exchanger, wherein during operation, a heat transfer fluid provided conveyed through the first volume has a first saturation temperature and the hat transfer fluid conveyed through the second volume has a second saturation temperature, the first saturation temperature and the second saturation temperature being different; and wherein the flow restricting element comprises a porous insert positioned within the second volume adjacent at least the second portion of the plurality of heat exchanger tubes, the porous insert having a porisity that changes uniformly over a length of the second header and being configured to restrict a fluid flow path between the first fluid pass and the second fluid pass, wherein a plurality of inwardly extending cavities are formed at a surface of the porous insert facing the plurality of heat exchanger tubes, each of the plurality of cavities being configured to receive a respective heat exchanger tube of the plurality of heat exchanger tubes extending into the second header.

2. The heat exchanger of claim 1, wherein a difference between the first saturation temperature and the second saturation temperature exceeds normal temperature variation within the at least one of the first header and the second header.

3. The heat exchanger according to claim 1, wherein the flow restricting element imparts a pressure drop on the heat transfer fluid conveyed there through during operation, such that a pressure of the heat transfer fluid in the first volume is greater than a pressure of the heat transfer fluid in the second volume.

4. The heat exchanger according to claim 3, wherein the pressure drop is between about 1 psi and about 12 psi.

5. The heat exchanger according to claim 3, wherein the pressure drop is about 6 psi.

6. The heat exchanger according to claim 3, wherein the flow restricting element comprises an orifice.

7. The heat exchanger according to claim 6, wherein a cross-sectional area of the orifice is between about 3% and about 30% of a cross-sectional area of the at least one of the first header and the second header in which it is disposed.

8. The heat exchanger according to claim 6, wherein a distributor fluidly coupled to the orifice is arranged within the second volume and is adjacent at least the second portion of the plurality of heat exchange tubes.

9. The heat exchanger according to claim 1, wherein the flow restricting element comprises a flow control valve, the flow control valve being movable to adjust a parameter of a fluid flow path between the first fluid pass and the second fluid pass.

10. The heat exchanger according to claim 1, wherein the plurality of heat exchange tubes are microchannel tubes.

11. The heat exchanger according to claim 1, wherein the first header comprises one or more partitions disposed therein and defining two or more discrete fluid volumes.

12. The heat exchanger according to claim 1, wherein the first header comprises two baffles forming a first volume, a second volume, and a third volume of the first header.

13. The heat exchanger according to claim 12, wherein during operation the heat transfer fluid conveyed through the third volume has a third saturation temperature, wherein the first saturation temperature and the third saturation temperature are different.

14. The heat exchanger according to claim 13, wherein the second saturation temperature and the third saturation temperature are identical.

15. The heat exchanger according to claim 13, wherein the second saturation temperature and the third saturation temperature are distinct.

* * * * *